US006004002A

United States Patent [19]

Giannone

[11] Patent Number: 6,004,002

[45] Date of Patent: Dec. 21, 1999

[54] UNIVERSAL SOLAR-POWERED SIGN ILLUMINATION SYSTEM

[76] Inventor: Darrell G. Giannone, 29495 Citation Ave., Romoland, Calif. 92585

[21] Appl. No.: 08/974,755

[22] Filed: Nov. 19, 1997

[51] Int. Cl.[6] ..... F21L 7/00

[52] U.S. Cl. ..... 362/183; 362/376; 40/559

[58] Field of Search ..... 362/183, 812, 362/376, 431; 40/559

[56] References Cited

U.S. PATENT DOCUMENTS 4,130,957 12/1978 Hampton ..... 40/607
4,319,310 3/1982 Kingsley ..... 362/183
4,384,317 5/1983 Stackpole ..... 362/183
4,718,185 1/1988 Conlin et al. ..... 362/183
5,101,329 3/1992 Doyle ..... 362/183

*Primary Examiner*—Nimeshkumar D. Patel
*Assistant Examiner*—Todd Reed Hopper
*Attorney, Agent, or Firm*—Graham & James LLP

[57] ABSTRACT

An improved solar lighting system can be applied to a number of temporary signs and is particularly adapted for use on a real estate sign. The system includes three parts: a solar generating unit containing a repositionable array or photovoltaic cells, electronic circuitry and storage batteries; an illumination unit containing electric lamps and reflectors and attachment devices for connection to a variety of signs; and a connecting cable for safely conducting electric energy between the units and for providing device security to discourage theft.

19 Claims, 4 Drawing Sheets

FIG. 2
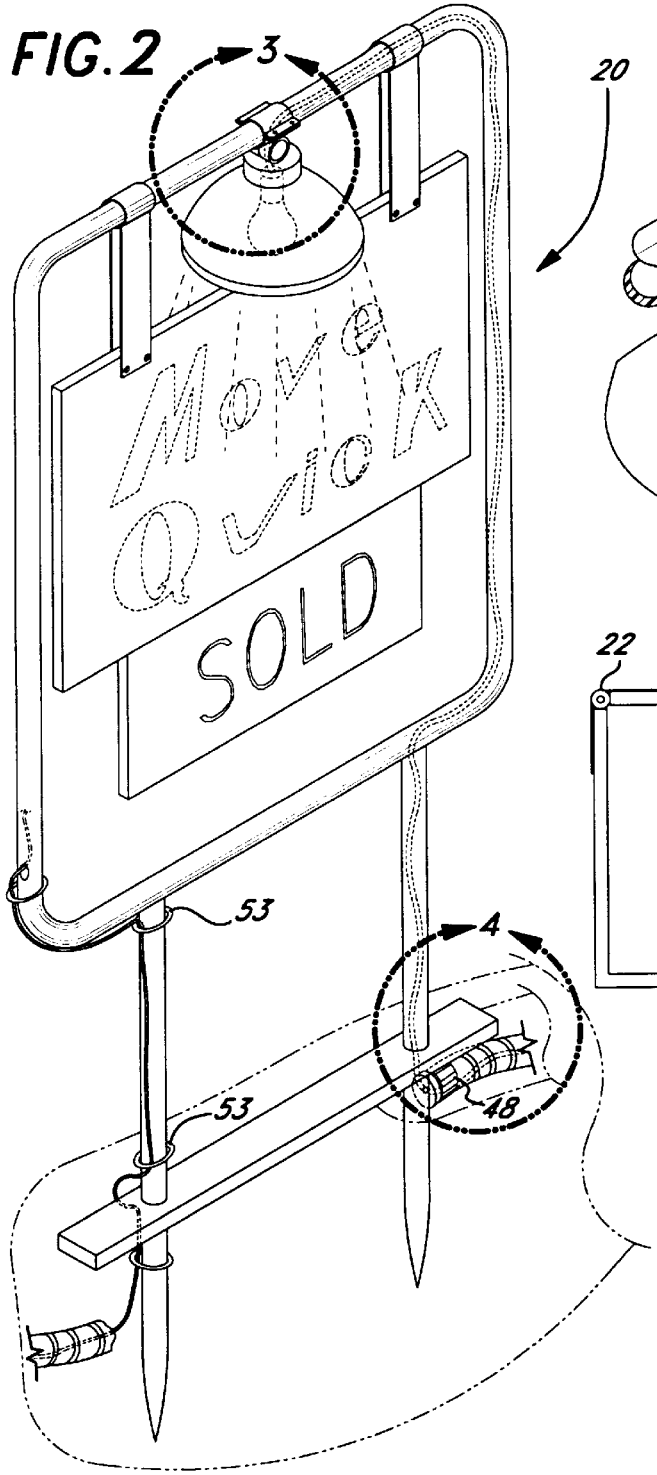
FIG. 3
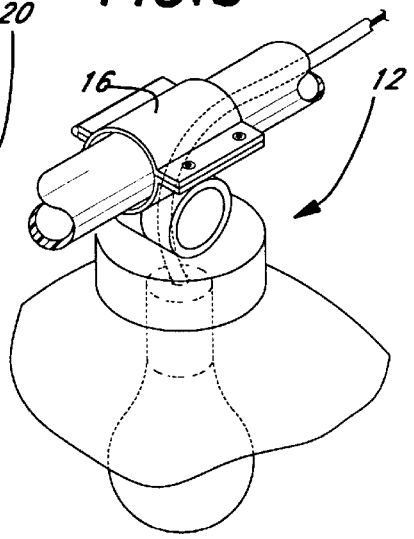
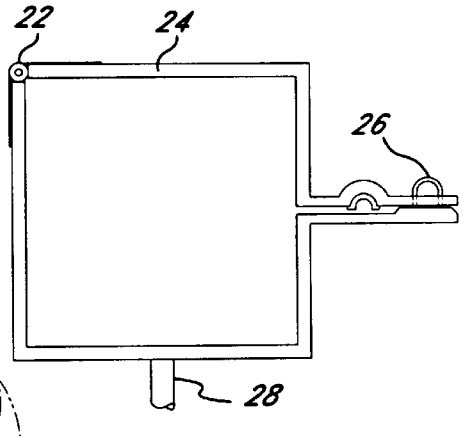
FIG. 6

UNIVERSAL SOLAR-POWERED SIGN ILLUMINATION SYSTEM

BACKGROUND OF THE INVENTION

1. Field of the Invention

The present field concerns providing lighting for signs and especially a solar-powered lighting device suited for application to a variety of signs, especially real estate signs.

2. Description of Related Art

The business of advertising depends on a number of channels of mass communication to disseminate its messages. Broadcast means such as radio or television are popular because they are instantaneous and reach a large number of people. However, the traditional means of advertisement, the printed word is far from being replaced. Various publications are filled with printed inducements, and outdoor signs which are, perhaps, one of the original means for advertising are ubiquitous.

Billboards and other permanent sign installations are effective where the advertisement to be disseminated is not necessarily linked to the location of the sign. However, many signs are uniquely linked to their geographic location. When a fast food restaurant has need for a food preparer, it is likely to mount a temporary sign "Fry Chef Wanted" on the door or some other conspicuous location associated with the facility. The public naturally associates the advertisement with the restaurant and know where the job is located. Similarly, when a piece of property is put on sale, it is usual to locate a real estate sign listing the realtor and other pertinent information somewhere on the sale property. Most people are familiar with the residential real estate sign and when looking for a home to purchase may well drive through a suitable neighborhoods looking for sign to see what properties are available.

Although weekends are prime house hunting times, many people cruise around after work looking for properties for sale. Therefore, it is often extremely advantageous to have the real estate signs prominently displayed and preferably lighted. It is rare that a home owner will run an electric power cord to a real estate, or other temporary, sign. Therefore, there is a significant need for a means to illuminate such signs without depending on the local electric utilities. Solar energy, as harnessed by photovoltaic cells, is a logical way to provide electric power without a connection to the electric utilities. Several inventors have attempted to adapt solar-powered lighting to real estate and other signs.

An early patent by Stackpole (U.S. Pat. No. 4,384,317) describes the electronic circuitry necessary for a more or less permanent solar-powered sign and solar generator. Doyle (U.S. Pat. No. 5,101,329) describes a solar-powered illumination system specifically adapted to real estate signs wherein a single unit containing solar cells, electronic circuitry and lights is removably attached to a typical real estate sign. Ruocco et al. (U.S. Pat. No. 5,467,076) add an alarm and radio transmitting device to the single unit of Doyle. While these one-piece units solve part of the problem of adding temporary lighting to existing signs, there is still considerable room for improvement.

Locating the solar cells directly on the sign as taught by Ruocco et al. and Doyle has several drawbacks. First, the relatively small surface area provided by the top of a sign cross arm rarely provides sufficient area for enough solar cells. The result is that the illumination provided is less than optimally brightness and tends to be of limited duration. While it is possible to provide a larger collector surface, such a configuration tends to be ungainly when placed directly on the sign. In addition, the exactly optimal location for a sign is rarely the optimal location for receiving solar energy. For example, the sign is placed for best street viewing even though there may be an overhanging tree or other object blocking solar access.

SUMMARY OF THE INVENTION

It is an object of the present invention to provide an improved solar lighting system that can be applied to a number of temporary signs and is particularly adapted for use on a real estate sign. The system includes three parts: a solar generating unit containing a repositionable array or photovoltaic cells, electronic circuitry and storage batteries; an illumination unit containing electric lamps and reflectors and attachment devices for connection to a variety of signs; and a connecting cable for safely conducting electric energy between the units and for providing device security.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings in which like reference numerals refer to like structures.

FIG. 2 shows a more detailed view of the sign and illumination unit of the present invention;

FIG. 3 shows a detailed view of the illumination unite;

FIG. 6 shows a detail view of one embodiment of the locking clamp;

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein specifically to provide an improved solar-powered sign illumination system.

Figure 1:
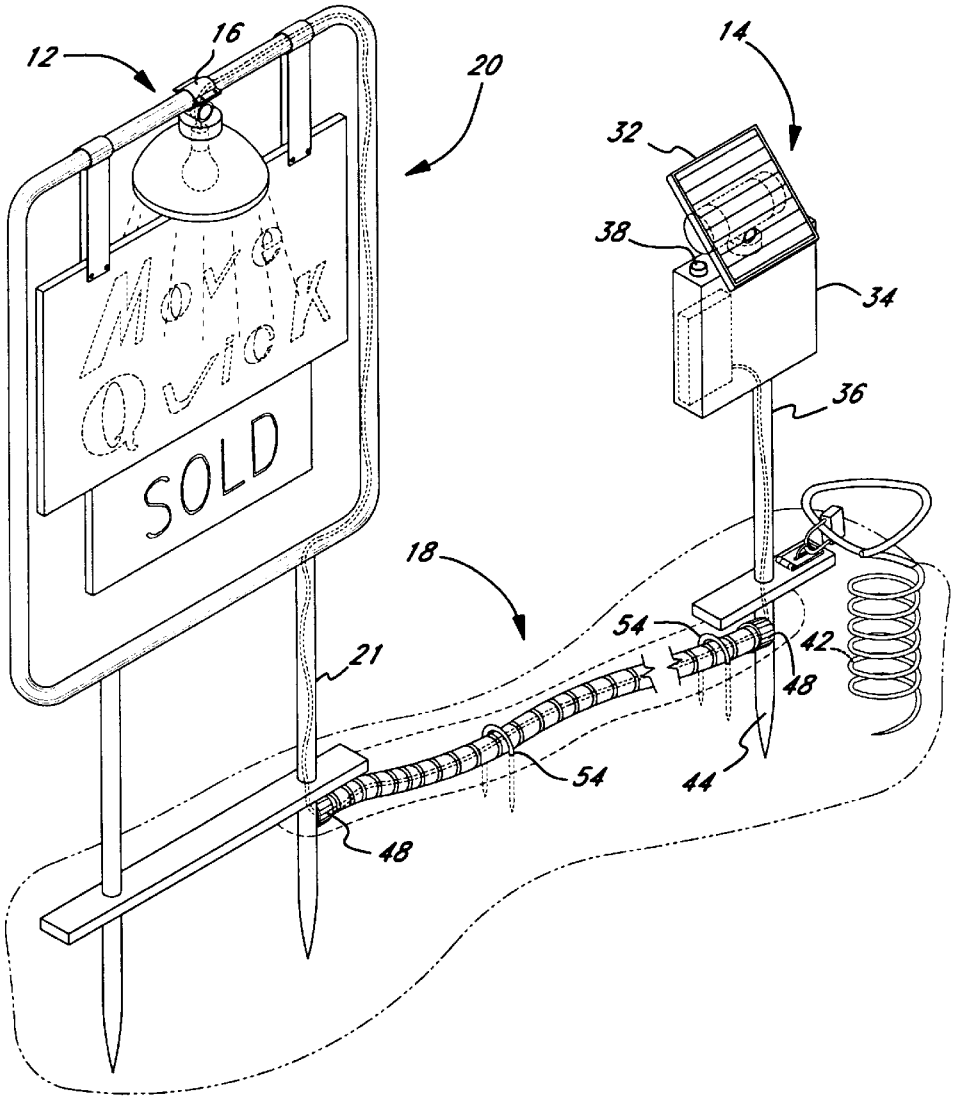
FIG. 1 shows an overall view of one embodiment of the present invention.

FIG. 1 shows the present invention in an embodiment configured for lighting a real estate sign 20. The invention comprises an illumination unit 12, a generation unit 14 and a cable means 18 for connecting these two components. The illumination unit 12 is attached to the sign to be illuminated. In this case the real estate sign 20 is composed of tubular metal members but an alternate wood embodiment, usually of 4 inch by 4 inch lumber, is also commonly used. The illumination unit 12 is attached to a locking clamp 16 which is sized to fit the tubular metal (see FIG. 3); an alternative embodiment of the clamp 16 is designed to fit 4 inch by 4 inch lumber (See FIG. 6). Thus, there can be a number of different locking clamps 16 each intended to fit different types of sign construction.

The preferred structure of the various clamps is the same: locking clamp 16 generally includes some type a hinge 22, an enclosing part 24 sized to fit the sign member, a locking hasp 26 and attachment means 28 for attaching the illumination unit 12. The hinge 22 can be eliminated and enclosing parts of the clamp 16 can simply be connected by other mechanical fasteners. The locking hasp 26 can readily be replaced by some other locking means such as toryx screws. The attachment means 28 contains a locking mechanism for secure attachment of the illumination unit 12. In some embodiments the attachment means 28 interacts with the locking hasp 26 so that a single locking device serves the dual purpose of attaching the illumination unit 12 and of securing the locking clamp 16.

The illumination unit 12 contains electric lamps and optionally a reflector system to focus light on the written surface of the sign. The unit 12 may be placed above the advertisement surface of the sign, below the surface or to the side of the surface depending on the design of the sign. The electric lamps can be incandescent, in which case high intensity krypton-containing bulbs are preferred, or they can be fluorescent tubes (see FIG. 7) or high intensity Light Emitting Diodes (LED) which provide illumination more efficiently than incandescent lamps.

The solar generation unit 14 (FIG. 5) comprises a solar panel 32, an electronics module 34, and mounting means 36. The solar panel 32 is advantageously attached by means of some type of adjustable joint so that it can be swiveled about to allow optimal reception of solar radiation. Alternatively, the solar panel 32 can be fixedly mounted on the generation unit 14 with the entire unit being repositioned to optimize reception of solar radiation. The important point is that the generation unit 14 is separate from the illumination unit 12 to allow separate optimal positioning of the sign and the generation unit 20.

The electronics module 34 contains voltage regulators and associated circuits to control the charging of a storage battery as is well known in the art. The precise circuitry will depend on the type of battery chosen; either lead acid, nickel cadmium or nickel hydride are good choices at this time. Other storage batteries are under development and are likely to be perfected in the near future. The circuitry also include a photodetector 38 for turning on power to the illumination unit 12 at dusk. The circuitry also advantageously contains a microprocessor timeing chip to turn off the power at a predetermined time since there is little need to illuminate the sign late at night when there is very little passing traffic. A timing chip can turn the illumination on and off a predetermined times designed to coincide with maximum traffic flow past the site. Although some solar lighting systems merely run until the battery is fully discharged, there is an advantage to limiting the duration of operation. By conserving stored power the system is capable of illuminating the sign even after a stormy day where there was little available solar radiation.

The mounting means 36 consists generally of a post 21 of sufficient height to elevate the solar panel 32 above any surrounding vegetation. The post 21 bears a terminal spike 44 for insertion into the soil. As cross piece or disk 46 is attached to the post 21 to provide a stop. Generally the spike 44 is inserted into the ground until the cross piece 46 contacts the ground. The cross piece 46 also provides a convenient means for applying one's weight, spade-like, for driving the spike 44 into the ground. The cross piece 46 advantageously provides a point of attachment for a security screw 42. The security screw 42 is screwed completely into the ground and then locked to the cross piece 46. The screw 42 cannot be pulled out of the earth without being unscrewed, and the spike 44 and cross piece 46 prevent the screw 42 from being turned, thereby locking the entire generation unit 14 into the ground.

Figures 4, 5, 9:
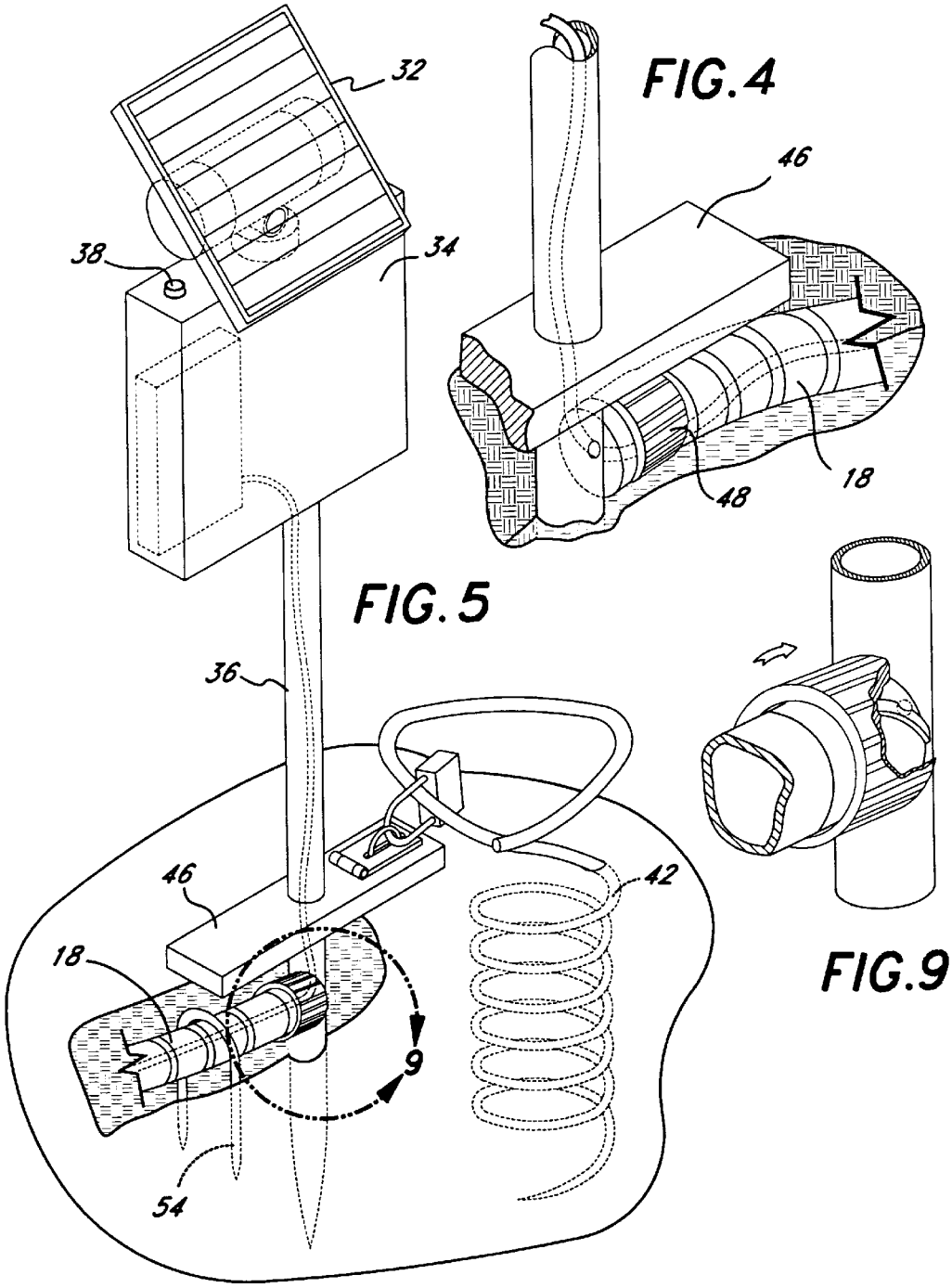
FIG. 4 shows a detail of the connection between the cable means and the solar generation unit of the present invention.
FIG. 5 shows and overall detail of the solar generation unit of the present invention.
FIG. 9 shows a detail of the locking cable socket.

The cable means 18 conveys electric power from the generation unit 14 to the illumination unit 12 and also supplies an additional modicum of security for the system by means of a locking connector 48. As previously explained, the locking clamp 16 makes it virtually impossible to remove the illumination system 12 from the sign 20 while the security screw 42 locks the generation unit 14 to the ground. Even if the generation unit 14 is somehow freed from the ground, the cable means 18 must be detached or else the thief must carry the entire sign 20 away. A locking cable socket 48 secures the cable means 18 to the generation unit 14. As shown in FIG. 9, the locking socket 48 can include a bayonet (as shown) or other mounting structure. The socket 48 is quickly locked in place (here by a simple twist); a padlock, toryx screw, or similar device (not shown) can then be employed to prevent ready removal of the socket 48.

The cable means 18 is in general appearance a flexible conduit such as is used in building wiring. However, the metal cladding can be hardened making it virtually impossible to cut with ordinary bolt cutters or hack saws. Alternatively, flexible plastic reinforced with hardened woven wire can also be used. In either case the cable means 18 is extremely difficult to sever. As an additional security factor the cable means 18 may contain a detection circuit that detects when the cable is cut or disconnected. This circuit can be used to set off an audible or broadcast alarm. Perhaps more effectively this circuit can be used to disable the generation unit 14 so that even if a thief succeeds in purloining the device, the stolen unit will be useless. This will discourage future theft of additional units. In addition, a warning notice explaining this self-destruction feature can be placed on the generation unit 14 and may discourage theft.

In the simplest embodiment the cable means 18 can merely be strung from the generation unit 14 to the sign 20, but this arrangement is generally unsatisfactory. It represents a significant safety hazard because a running child might fail to see the cable means 18 and be strangled by the cable or injured in some other way. Further, a cable means 18 suspended in the air can impede lawn mowing and is generally unsightly. Therefore, a preferred method of running the cable means 18 is to run from below the cross piece 46 to the base of the sign upright 21. The cable means 18 can then be attached to the upright 21 by staples (for wooden signs) or ties 53 as shown.

Figure 7:
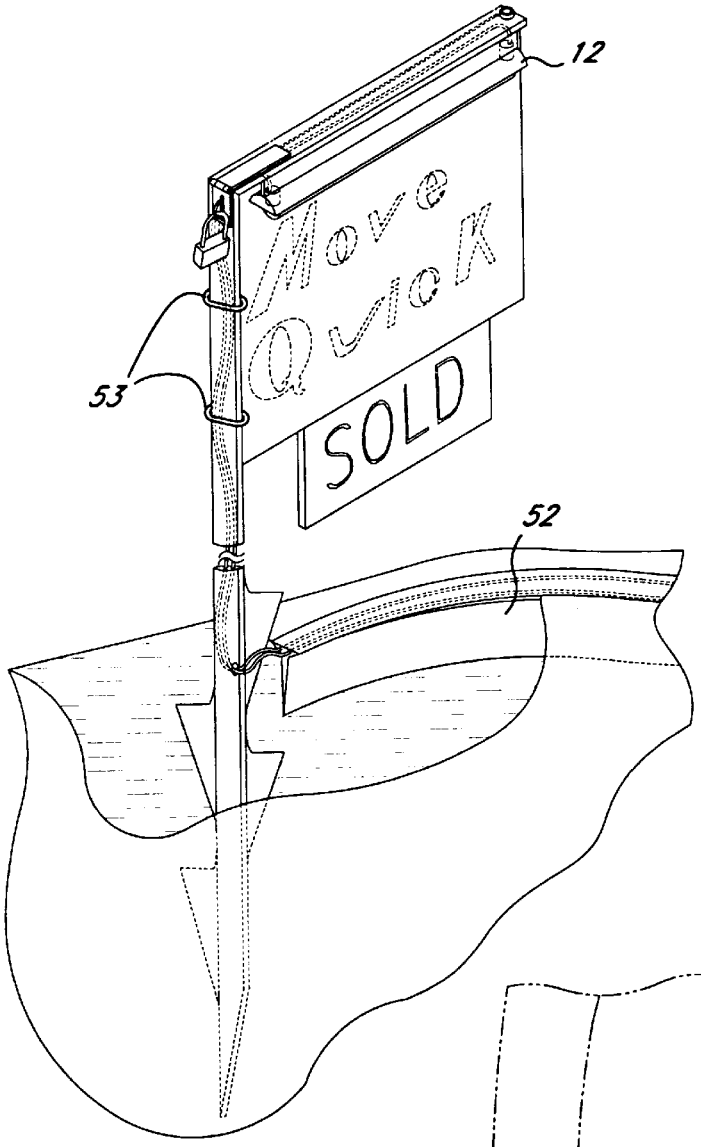
FIG. 7 shows an alternate embodiment of the sign and illumination unit.
Figure 8:
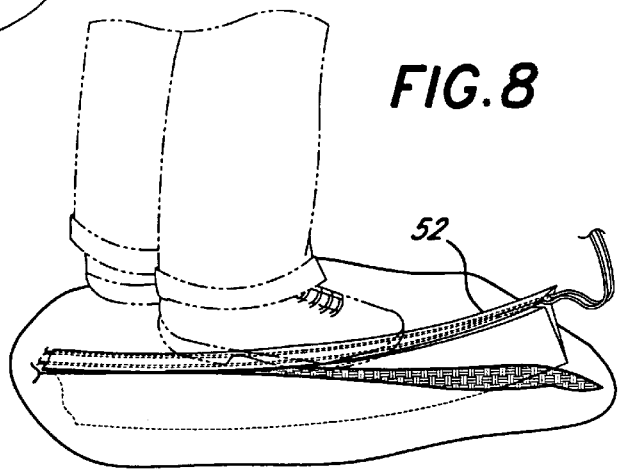
FIG. 8 shows the installation of one embodiment of the cable means.

In the preferred configuration the cable means 18 would run along the surface of the earth to the base of the sign upright 21. This run can be advantageously stabilized by large wire staples or wickets 54 driven into the ground. Alternatively, a shallow slit can be cut into the earth or turf so that the cable means 18 can be depressed slightly below soil level. This prevents the cable means 18 from being any type of safety hazard or from interfering with operation of a lawn mower. An alternate embodiment equips the cable means 18 with an insertion flange 52. As shown in FIG. 7 and 8 the insertion flange 52 protects the electrical connections and provides a wedge so that the cable means 18 can be installed by simply stepping on the device to drive it into the ground. The top surface of the insertion flange 52 can conveniently be colored to blend with the surface into which it is inserted (e.g., green for use on a lawn).

FIG. 7 also shows an alternative embodiment of the sign and the illumination unit 12. Here, an elongate fluorescent tube is used to light the advertising surface of the sign. A lock can be used to removably attach the illumination unit 12 to the sign. While not specifically illustrated in the drawings, there is no reason why a single generation unit 14 cannot support more than one sign; this is particularly true where small signs or the type shown in FIG. 7 are employed.

Many alterations and modifications may be made by those having ordinary skill in the art without departing from the spirit and scope of the present invention. The words used in this specification to describe the invention and its various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself. The definitions of the words or elements of the following claims are, therefore, defined in this specification to include not only the combination of elements which are literally set forth, but all equivalent structure, material or acts for performing substantially the same function in substantially the same way to obtain substantially the same result.

In addition to the equivalents of the claimed elements, obvious substitutions now or later known to one with ordinary skill in the art are defined to be within the scope of the defined elements. The claims are thus to be understood to include what is specifically illustrated and described above, what is conceptually equivalent, what can be obviously substituted and also what essentially incorporates the essential idea of the invention. Those skilled in the art will appreciate that various adaptations and modifications of the just-described preferred embodiment can be configured without departing from the scope and spirit of the invention. The illustrated embodiment has been set forth only for the purposes of example and that should not be taken as limiting the invention. Therefore, it is to be understood that, within the scope of the appended claims, the invention may be practiced other than as specifically described herein.

What is claimed is:

1. A solar-powered sign lighting system comprising:

an illumination module including electric lamps for removable attachment to a sign so as to provide illumination to an advertising surface of the sign;

a solar generation unit separate from the illumination module and standing apart from any illuminated sign including a panel of photovoltaic cells, storage batteries, electronic circuits for charging the batteries with electricity generated by the photovoltaic cells, mounting means for attaching the generation unit to the ground and security means for impeding removal of the generation unit from the ground; and cable means for providing electrical communication between the illumination module and the generation unit, wherein the security means further comprise means for activating an alarm and/or disabling the generation unit if the cable means becomes disconnected.

2. The system of claim 1, wherein the electric lamps are selected from the group consisting of incandescent lamps, light emitting diodes and fluorescent lamps.

3. The system of claim 1 further comprising control means for activating and deactivating the illumination module at predetermined times or under predetermined conditions.

4. The system of claim 1, wherein the security means comprises a screw that is screwed into the ground and locked onto the mounting means.

5. The system of claim 1, wherein the mounting means is configured so that the cable means can be depressed below the soil surface when traveling from the generation unit to a sign bearing the illumination module.

6. The system of claim 1, wherein the illumination module further comprises a locking clamp for attachment to portions of a sign.

7. The system of claim 1, wherein the cable means further comprises a wedge-shaped flange running longitudinally along the cable means to facilitate installation of the cable means into soil.

8. A solar-powered sign lighting system comprising:

an illumination module including electric lamps and including a locking clamp for removable attachment to a sign so as to provide illumination to a surface of the sign;

a solar generation unit separate from the illumination module and standing apart from any illuminated sign including a panel of photovoltaic cells, storage batteries, electronic circuits for charging the batteries with electricity generated by the photovoltaic cells, locking socket connectors in electrical communication with the circuits and the photovoltaic cells, mounting means for attaching the generation unit to the ground and security means for impeding removal of the generation unit from the ground wherein the locking socket connectors are at or below ground level when the mounting means and the security means are fully installed; and cable means for providing electrical communication between the illumination module and the generation unit by lockingly engaging the locking socket connectors to prevent removal by unauthorized personnel.

9. The system of claim 8, wherein the electric lamps are selected from the group consisting of incandescent lamps, light emitting diodes and fluorescent lamps.

10. The system of claim 8 further comprising control means for activating and deactivating the illumination module at predetermined times or under predetermined conditions.

11. The system of claim 8, wherein the security means comprises a screw that is screwed into the ground and locked onto the mounting means.

12. The system of claim 8 further comprising means for activating an alarm and/or disabling the generation unit if the cable means becomes disconnected.

13. The system of claim 8, wherein the cable means further comprises a wedge-shaped flange running longitudinally along the cable means to facilitate installation of the cable means into soil.

14. A solar-powered sign lighting system comprising: an illumination module including electric lamps for removable attachment to a sign so as to provide illumination to an advertising surface of the sign;

a solar generation unit separate from the illumination module and standing apart from any illuminated sign including a panel of photovoltaic cells, storage batteries, electronic circuits for charging the batteries with electricity generated by the photovoltaic cells, mounting means for attaching the generation unit to the ground and security means for impeding removal of the generation unit from the ground;

cable means for providing electrical communication between the illumination module and the generation unit; and insertion means attached to said cable means for penetrating a soil surface to insert said cable means therein, said insertion means comprising a fin protruding from a lower surface of said cable means and running a length of said cable means.

15. The system of claim 14, wherein the electric lamps are selected from the group consisting of incandescent lamps, light emitting diodes and fluorescent lamps.

16. The system of claim 14 further comprising control means for activating and deactivating the illumination module at predetermined times or under predetermined conditions.

17. The system of claim 14, wherein the security means comprises a screw that is screwed into the ground and locked onto the mounting means.

18. The system of claim 14 further comprising means for activating an alarm and/or disabling the generation unit if the cable means becomes disconnected.

19. The system of claim 14, wherein the illumination module further comprises a locking clamp for attachment to portions of a sign.

* * * * *